US010441865B2

(12) United States Patent
Direnzo

(10) Patent No.: US 10,441,865 B2
(45) Date of Patent: Oct. 15, 2019

(54) REFLEX TRAINING DEVICE

(71) Applicant: Louis Direnzo, Rochester, NY (US)

(72) Inventor: Louis Direnzo, Rochester, NY (US)

( * ) Notice: Subject to any disclaimer, the term of this patent is extended or adjusted under 35 U.S.C. 154(b) by 0 days.

(21) Appl. No.: 15/836,780

(22) Filed: Dec. 8, 2017

(65) Prior Publication Data

US 2018/0161657 A1 Jun. 14, 2018

Related U.S. Application Data

(60) Provisional application No. 62/432,540, filed on Dec. 9, 2016.

(51) Int. Cl.

| | |
|---|---|
| ***A63B 69/38*** | (2006.01) |
| ***A63B 69/00*** | (2006.01) |
| ***A63B 67/20*** | (2006.01) |
| ***A63B 69/20*** | (2006.01) |
| ***A63C 19/00*** | (2006.01) |
| ***A63B 71/02*** | (2006.01) |

(52) U.S. Cl.

CPC ..... *A63B 69/38* (2013.01); *A63B 67/20* (2013.01); *A63B 69/00* (2013.01); *A63B 69/0002* (2013.01); *A63B 69/0015* (2013.01); *A63B 69/0024* (2013.01); *A63B 69/0075* (2013.01); *A63B 69/205* (2013.01); *A63B 69/208* (2013.01); *A63C 19/00* (2013.01); *A63B 2069/0008* (2013.01); *A63B 2071/026* (2013.01); *A63B 2209/10* (2013.01); *A63B 2220/30* (2013.01); *A63B 2220/53* (2013.01); *A63B 2220/64* (2013.01); *A63B 2220/806* (2013.01); *A63B 2225/093* (2013.01); *A63B 2225/50* (2013.01); *A63C 19/005* (2013.01)

(58) Field of Classification Search

CPC ..... A63B 69/20; A63B 69/203; A63B 69/24; A63B 69/38–69/385; A63B 2069/0008

See application file for complete search history.

(56) References Cited

U.S. PATENT DOCUMENTS

2012/0129660 A1* 5/2012 Eem ..... A63B 69/203 482/83

2013/0231223 A1* 9/2013 Scully ..... A63B 69/20 482/87

* cited by examiner

*Primary Examiner* — Jennifer M Deichl

(57) ABSTRACT

A reflexive training device having a rotating member that rotates around an axis while also traveling perpendicular to the plain of rotation to present the rotating member at variable vertical locations during use.

11 Claims, 21 Drawing Sheets

REFLEX TRAINING DEVICE

CROSS-REFERENCE TO RELATED APPLICATIONS

This application claims the benefit of U.S. Provisional Patent Application 62/432,540, filed Dec. 9, 2016. The contents of this application are hereby incorporated by reference.

FIELD OF THE INVENTION

Embodiments of the present invention relate to the field of fitness and reflex training; more particularly, embodiments of the present invention relate to mixed martial arts, boxing, punching, self-defense and reflex sports. Various embodiments of the present invention are in the technical field of baseball, tennis, hockey, cricket and the like.

BACKGROUND OF THE INVENTION

In the fitness field, athletes, trainers and recreational users often look for new and unique ways to train. For example, in boxing gym, there are a number of specific pieces of training equipment that can be found. Such equipment includes heavy bags, speed bags, jump ropes, reflex bags, water bags, and traditional weight lifting stations. Each of these pieces of equipment trains the user in a different, but unique way. Similarly, when training for a reflex sport, such as baseball, athletes may go to the batting cage or hone their batting skills on alternative hitting devices.

In gyms and home training setups, it desirable to have training equipment that trains a user in a unique way.

In areas with limited space, it is desirable to have training equipment that can share space or perform multiple functions to reduce the overall footprint of equipment.

SUMMARY OF THE INVENTION

The present invention is a reflexive training device having a rotating member that rotates in a horizontal plane and which also travels in a vertical plane while rotating. When a user strikes the rotating member, the user receives a reactive response which gives feedback to the user. The present invention further varies the ideal impact height by traveling in a vertical plane. This requires the user to adapt, presenting a unique training experience to the user. In certain embodiments, the reflexive training device is a stand-alone device. In other embodiments, the reflexive training device attaches to existing equipment.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only. Identical reference numerals have been used, where possible, to designate identical features that are common to the figures, and wherein.

DETAILED DESCRIPTION OF THE PRESENT INVENTION

Figure 1:
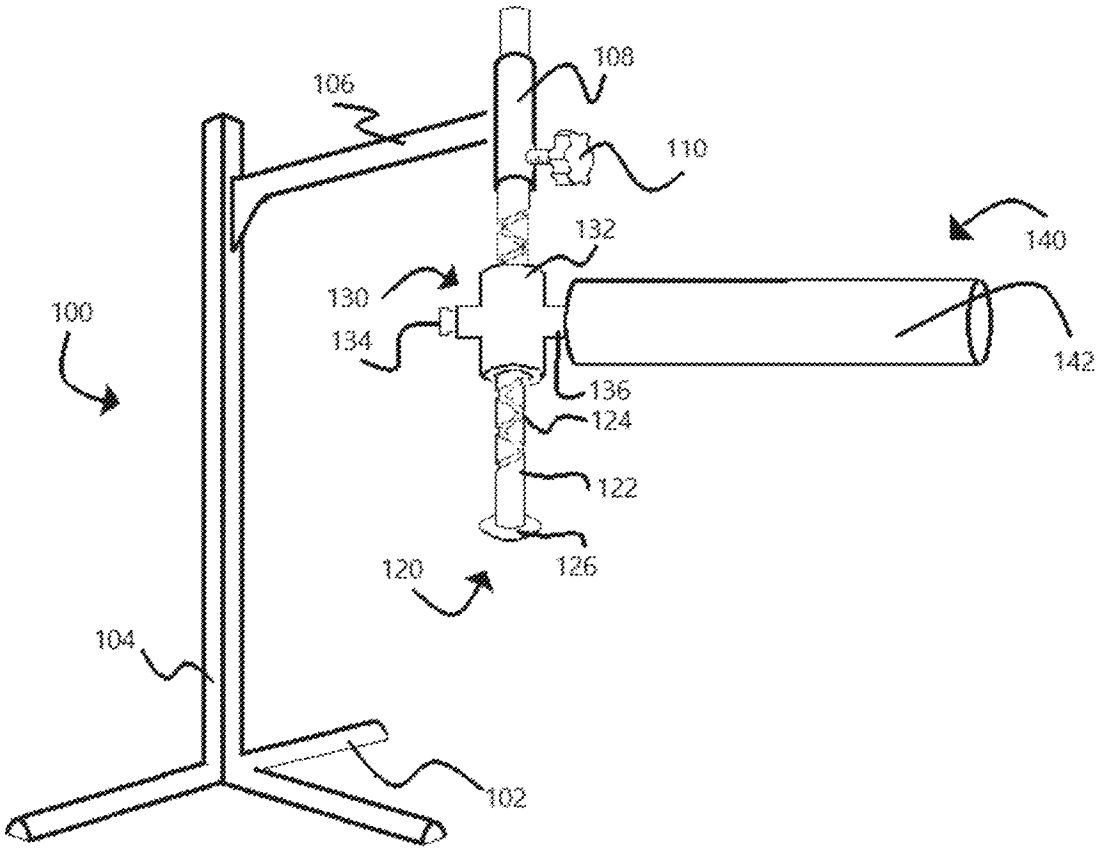
FIG. 1 is a perspective view of a reflexive training device.
Figure 3:
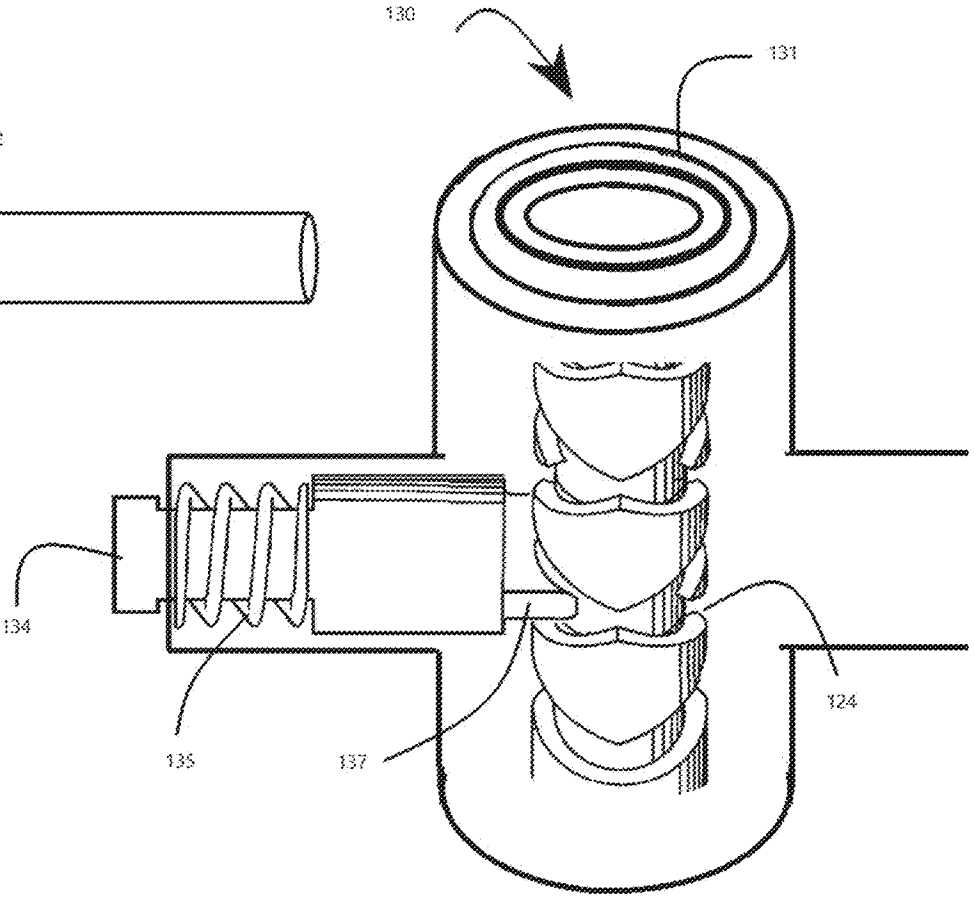
FIG. 3 is an isometric view of a rotating bracket.
Figure 2:
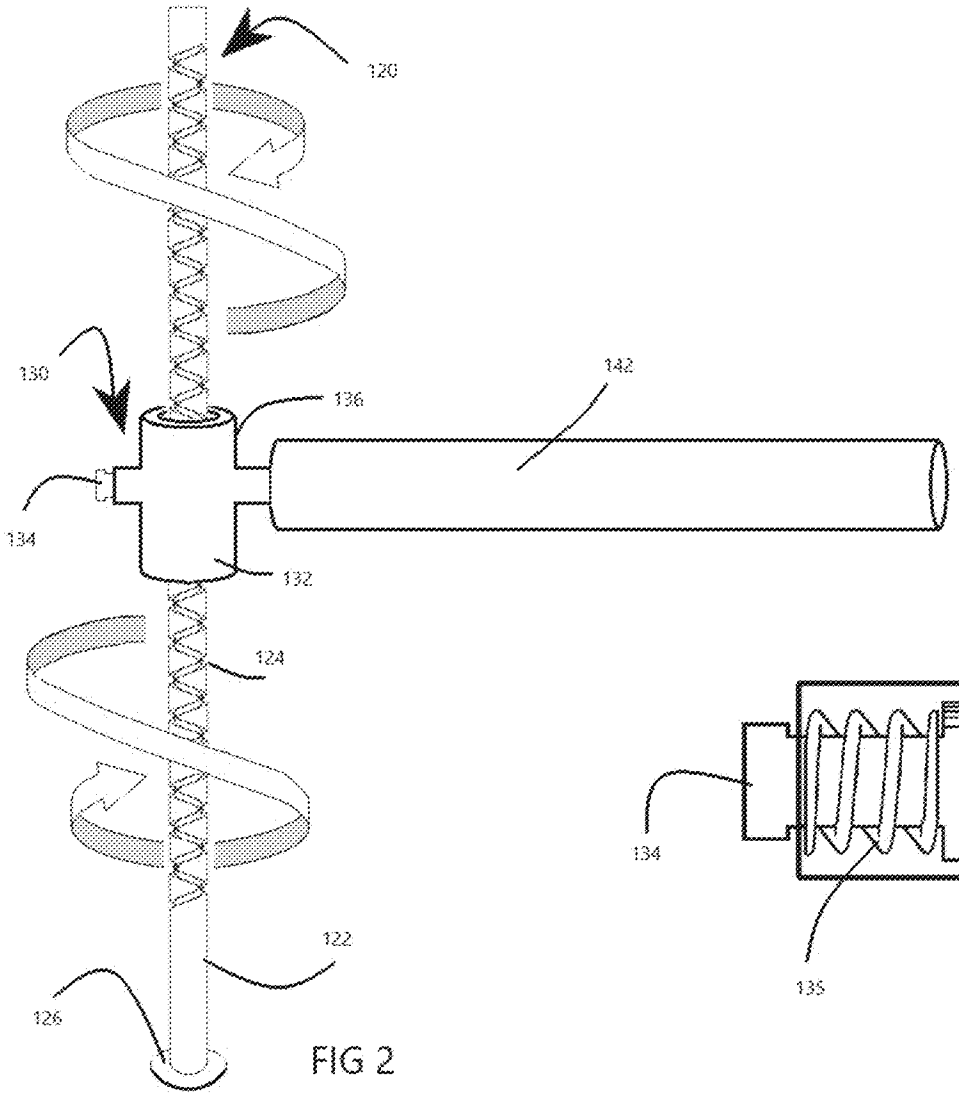
FIG. 2 is perspective view of a vertical member, rotating bracket and rotating member.
Figure 5:
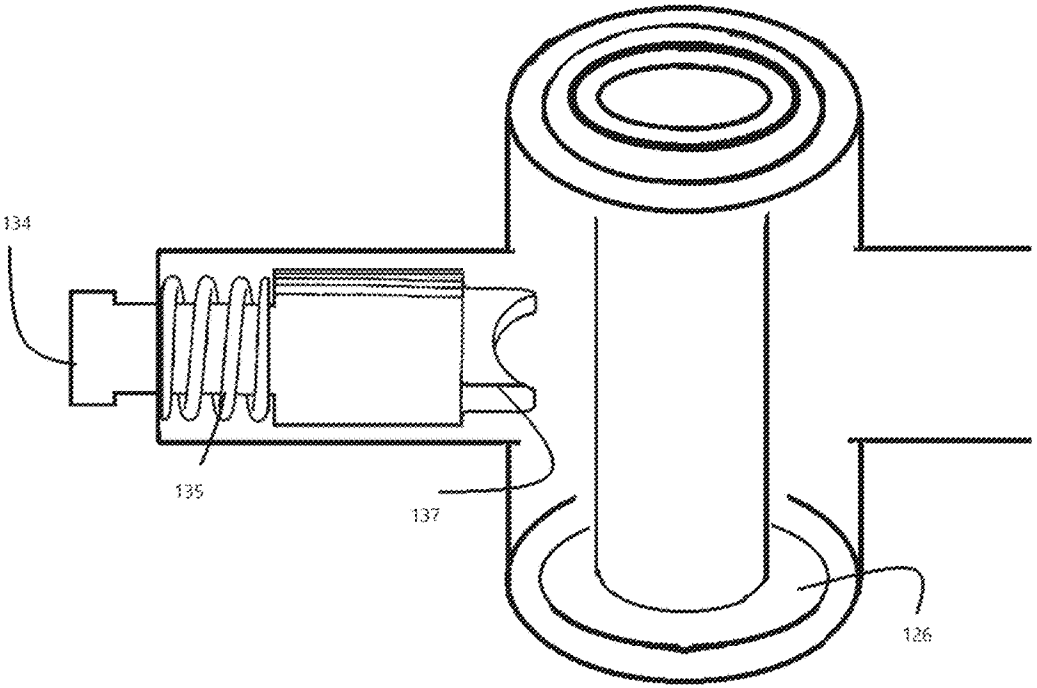
FIG. 5 is a is an isometric view of a rotating bracket.
Figure 4:
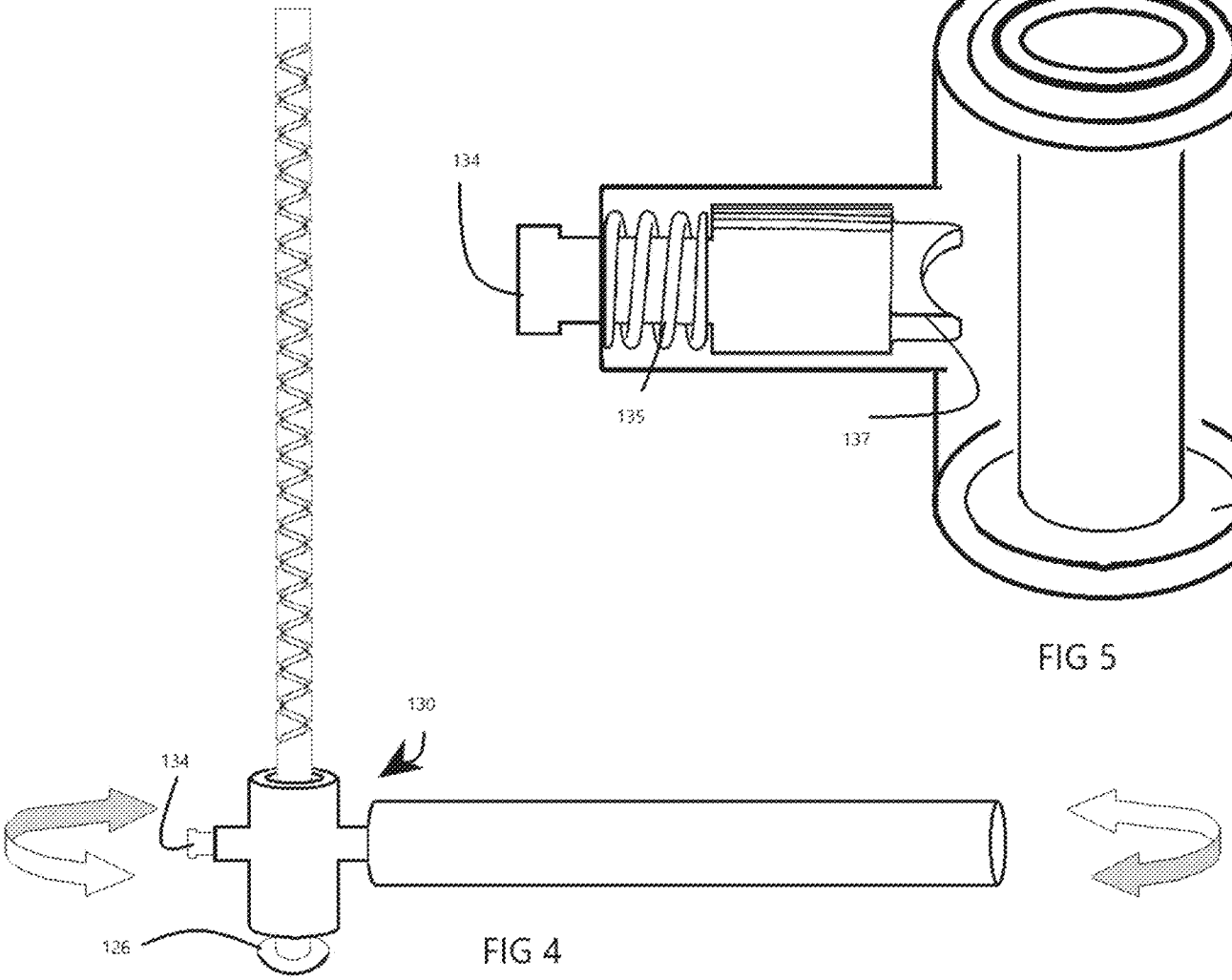
FIG. 4 is a perspective view of a vertical member, rotating bracket and rotating member.
Figure 7:
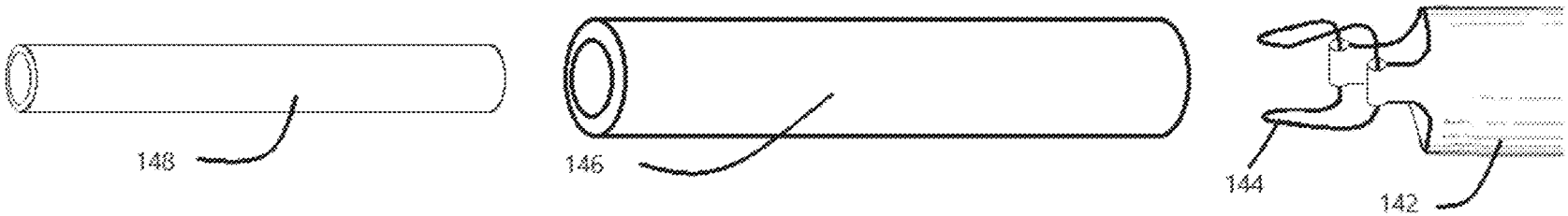
FIG. 7 is an exploded view of a rotating member.
Figure 6:
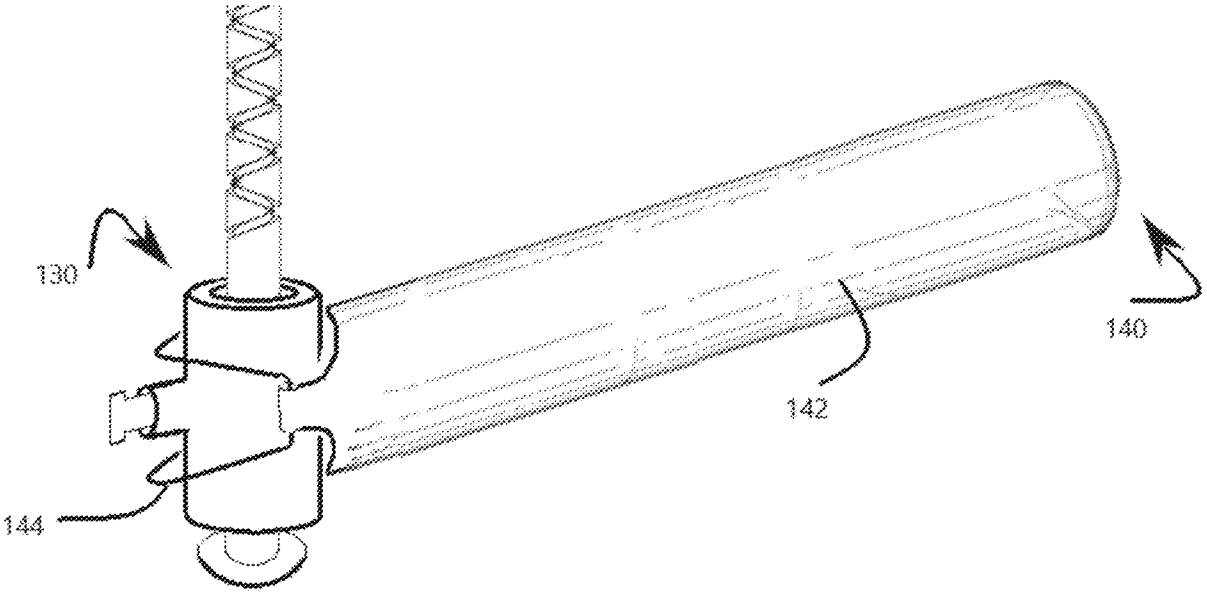
FIG. 6 is perspective view of a vertical member, rotating bracket and rotating member.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

A Referring to FIGS. 1-7 there is shown a reflexive training device mounted in stand. The reflexive training device having a stand 100, a vertical member 120 mounted to the stand 100, a rotating bracket 130 capable of rotating around the vertical member 120 and a rotating member 140 in communication with the rotating bracket 130.

In more detail, still referring to FIGS. 1-7, when a user strikes the rotating member 140, the rotating member 140 rotates in a substantially horizontal plane around an axis, which is the vertical member 120. While rotating, the rotating member 140 also travels in a vertical direction to vary the height the rotating member is presented to a user, requiring the user to adapt prior to the next strike. The rotating bracket has an engagement member 137 which engages the threads 124 of the double helical rod 122. While the rotating member 140 is in motion, the engagement member 137 glides along the threads 124, thereby changing the vertical height of the rotating bracket 130 and the rotating member 140 accordingly. At either end of the threads 124, the threads 124 change pitch and cause the engagement member 137 to change vertical direction. The engagement member 137 is sized such that it can traverse the intersecting portions of the threads 124 on the double helical rod 122 to prevent the engagement member 137 from becoming dislodged.

Still referring to FIGS. 1-7, a stand 100 is utilized to support the vertical member 120. The stand 100 has a plurality of legs 102 and a vertical support 104 extending from the legs 102 and having a horizontal support 106 connected thereto. While FIG. 1 depicts three legs, it is understood that any number of legs or alternative base designs such as weighted stands often used for boxing apparatus could be utilized without detracting from the invention so long as the base is sufficient to support the reflexive training device in use. A locking mechanism 110 is in communication with the horizontal support 106 and allows for the attachment and securing of the vertical member 120. The locking mechanism 110 is shown as a friction stop which utilizes friction to hold the vertical member 120 in place. The height of the vertical member 120 can be adjusted by sliding the double helical rod 122 through the vertical member housing 108 and engaging the locking mechanism 110. While the locking mechanism 110 is shown as a single threaded friction attachment, in alternative embodiments, multiple locking mechanisms are used to further stabilize the vertical member 120. In another embodiment, the locking mechanism 110 may be any suitable attachment mechanism, including, but not limited to, threaded clamps, bolts, locking pins, friction locking mechanisms, retention pins, slide pin, clamping devices, push locking pins, pipe clamps, screw clamps, button locks, quick release pins, and spring-assisted pins. In one embodiment, the vertical member, 120 further includes additional lock retention features to allow a more secure connection of such vertical member retention device, such as holes, grooves or detents.

Referring again to FIGS. 1-7, a rotating bracket 130 is shown. The rotating bracket 130 has a housing 132 vertical member contact 131 and an engagement member 137 to contact the double helical rod 122. The vertical member contact 131 provides a low friction surface to allow the rotating bracket 130 to glide while the engagement member 137 engages the threads 124 of the double helical rod 122 causing the rotating bracket 130 to travel vertically along the double helical rod 122 while rotating. In one embodiment the rotating bracket 130 contacts the double helical rod 122 directly. In another embodiment, the vertical member contact 131 is a replaceable part such as a spacer, sleeve or a bearing made of nylon, plastic, steel or the like. Having the vertical member contact 131 as a replaceable part allows for the user to perform service and to keep the friction low. The housing 134 can be made of any suitable material, such as machined aluminum, plastic, steel, casted plastic, metal or the like. In an exemplary embodiment, the housing 134 is about 4 inches in length and about 2.5 inches in width. It is understood that other sizing options are contemplated.

Referring still to FIGS. 1-7, the vertical member contact 131 and the engagement member 137 may be any suitable material that allows for a low friction rotation. In one embodiment, the double helical rod 122 is a stainless steel and the vertical member contact 131 is a nylon bearing. In an embodiment, the vertical member contact 131 is a plastic bearing having a 1-inch inner diameter, 2 inch outer diameter and about a 1 inch width. In an embodiment, the engagement member 137 is made of nylon, bronze, steel or brass. The engagement member 137 sets in the threads 124. The engagement member 137 is engaged by use of an engagement device 134 that allows the user to engage or disengage the engagement member 137 as shown more closely in FIG. 3 and FIG. 5. The engagement device 134 may be, but is not limited to a thumbscrew, ball knob or pull string. A retention device 135 is used to keep the engagement member 137 engaged with the threads 124. The retention device may be a spring, a threaded connection, a clamp or a locking pin. In an embodiment, the retention device 135 is a stainless steel spring having a 1 inch height. In an alternative embodiment, the retention device is a locking device that remains engaged. When the engagement device 134 is disengaged, the rotating bracket 130 can freely move along the vertical member 120. In one embodiment, a limit stop 126 allows the rotating bracket 130 to rest at a fixed height so that it may rotate without moving vertically along the vertical member 120. The limit stop may be a washer, collar, clamp, pin or quick connect collar. In one embodiment, the vertical member 120 includes a groove (not shown), located either above or below the threads 124, which remains substantially orthogonal to the length of the double helical rod. The engagement member 137 can engage this groove and keep the rotation bracket 130 at a fixed height during use.

Referencing still FIGS. 1-7 the rotating member 140 connects to the rotating member housing 136 of the rotating bracket 130. In an embodiment, the rotating member housing 136 is made of aluminum, metal, plastic, polymer or alloy. In an embodiment, the rotating member housing 136 has a length of about 3 inches. In an embodiment, the rotating member housing 136 has an inner diameter of about 0.5 inches. In an embodiment, the core 148 is pressure fit to the rotating member housing 136. In another embodiment, an epoxy affixes the core 148 to the rotating member housing 136. In yet another embodiment, the core 148 has a threaded end which threads onto or into the rotating member housing 136. In a further embodiment, the core 148 is affixed to the rotating member housing 136 via a mechanical mechanism such as a pin, a clamp, or other like devices. In an embodiment, the core 148 is made from a rigid material such as a metal, an alloy, a rubber, a plastic or a polymer. In an embodiment, the core is polyvinyl chloride. In an embodiment, the core 148 has a diameter of between 0.25 and 1 inch. In an embodiment, a cushioning 146 surrounds the core 148 to provide a more forgiving contact surface. The cushioning 146 can be any suitable material such as polymer foam, natural or synthetic fiber, aqueous filled bladder, gel, cotton padding or inflatable bladder. In one embodiment, the cushioning 146 has an inner diameter of about 0.75 inches to receive the core 148. In one embodiment, the cushioning 146 has an outer diameter of about 2 inches. In an embodiment, the core 148 and cushioning 146 are a single element. In another embodiment, the core 148 and cushioning 146 are multiple elements. In an embodiment, the cushioning 146 is covered with a wrap 142. The wrap 142 protects the inner elements from sweat and repeated contact, thus extending the usable life of such components. Wrap materials are frequently utilized in boxing equipment such as speed bags and heavy bags. In one embodiment, the wrap material is leather, rubber, spandex, vinyl or neoprene. In another embodiment, the wrap material is water proof neoprene and about 2 mm thick. The wrap 142 can attach the cushioning 146 via frication. In addition, the wrap 142 can include a wrap attachment 144 to secure the wrap to the cushioning 146. In an embodiment, the wrap attachment 144 wraps around the rotating bracket 130 to secure the wrap 142 and the entire rotating member 140 to the rotating bracket 130. The wrap attachment can be a slip on elastic connector, a hook and loop attachment, a snap, a rubber string, a neoprene strap, a zipper or other similar attachment mechanisms.

The overall length of the rotating member 140 can vary based on a user's needs. For example, shorter rotating members rotate at a higher speed and provide less contact area. In one embodiment, the rotating member 140 is about 30 inches in length. In another embodiment, the rotating member 140 is between 25 and 35 inches in length. In another embodiment, the rotating member 140 is between 20 and 40 inches in length. In yet another embodiment, the rotating member 140 is between 10 and 60 inches in length. While the rotating member 140 is depicted as being a cylinder with a relatively consistent diameter, it is envisioned that the rotating member may also include different shaped strike zone such as balls, discs or bags. For example, a speed bag mounted to the end of the rotating member, or a ball located in the center of the rotating member would provide distinct strike zones for a user. It is further contemplated that two-sided rotating member be utilized. Each one of the two sides extends away from the rotating bracket and may contain the same or different strike zones, lengths, diameters, or materials to give the user a distinct training opportunity.

In use, when a user strikes the rotating member 140, the force causes the rotating member 140 to rotate around the vertical member 120. The threads 124 of the double helical rod 122 cause the rotating bracket 130 and thus the rotating member 140 to either move up or down the vertical member 120. Some users prefer that the rotating member 140, rotate at a near consistent speed, whether traveling up or down the vertical member 120. To achieve this, a number of variables must be adjusted; the total weight of the rotating bracket 130, the pitch of the threads 124, the total weight and size of the rotating member 140, the location of the weight in the rotating member 140 and the surface area of the retention device 135 against the vertical member 120 increasing the total friction and acting like a brake. By optimizing these variables, the desired difference in the speed of rotating member 140 traveling up the vertical member 120 and traveling down the vertical member 120 can be optimized. In an exemplary embodiment, the rotating bracket weights about 490 grams. In an exemplary embodiment, the rotating member 140 weights about 385 grams. In another exemplary embodiment, the rotating bracket weights between 250 and 750 grams. In another exemplary embodiment, the rotating member weighs between 300 and 800 grams. In an embodiment, the pitch of the threads is between 1.75 in and 2.25 in per rotation. In another embodiment, the pitch of the threads is between 1.00 in and 2.75 in per rotation. In yet another embodiment, the pitch of the threads is between 0.25 in and 3.25 in per rotation. The threads 124 extend along a portion of the vertical member 120. In an embodiment, the threads have a depth of about 0.20 inches and a width of about 0.1875 inches. In one embodiment, the threads 124, extend for at least 7 inches but can be made longer to the particular need. In another embodiment, the threads 124 are between 7 and 18 inches. In another embodiment, the threads 124 are between 6 and 24 inches. In yet another embodiment, the threads 124 extend up to 83 inches.

In one embodiment, the rotating member 140 includes at least one metric sensor such as an accelerometer or force sensor to provide a user with measurement information for at least one of current speed, average speed, max speed, force data (max power, average power per strike, last strike power), strike frequency information and accuracy data. Additional sensors and gauges are utilized to provide more accurate data. By placing sensors in different locations, it is possible to identify the accuracy of a user's strike as compared to a preferred strike zone. In addition, the sensors can measure the force of an impact and also the current speed and acceleration of the rotating member. This information can be used to calculate useful information for the user. In one embodiment, the sensor(s) wirelessly transmit data to a display capable device such us a tablet or mobile device. Optionally, a mount places this display in viewable location that the user can identify while at the same time, continuing to operate the reflexive training device. If utilizing a device with a front camera, the mount can also position the device to capture live video of the user's training session. In addition, data and video can be stored and later analyzed in more detail after the conclusion of a training session.

The double helical rod is sized and made of material to provide adequate stability and usability. In one embodiment, the double helical rod 122 has an outer diameter of about 1 inch. In another embodiment, the double helical rod 122 has an outer diameter between about 0.75 and 1.25 inches. In yet another embodiment, the double helical rod 122 has an outer diameter between 0.125 and 6 inches. In one embodiment, the double helical rod 122 is about 27 inches in length. In another embodiment, the double helical rod 122 is between 20 and 36 inches in length. In yet another embodiment, the double helical rod 122 is between 10 and 70 inches in length. The double helical rod 122 may be any suitable material such as metals, alloys, polymers, composites, plastics or the like. In one embodiment, the double helical rod is stainless steel.

In an alternative embodiment, the vertical member 120 contains a standard thread as opposed to the double helical rod 122. This embodiment does not have a return feature and the user must cause the rotating member to rotate in an opposite direction in order for the rotating member to continue to climb or descend the vertical member.

Figure 8:
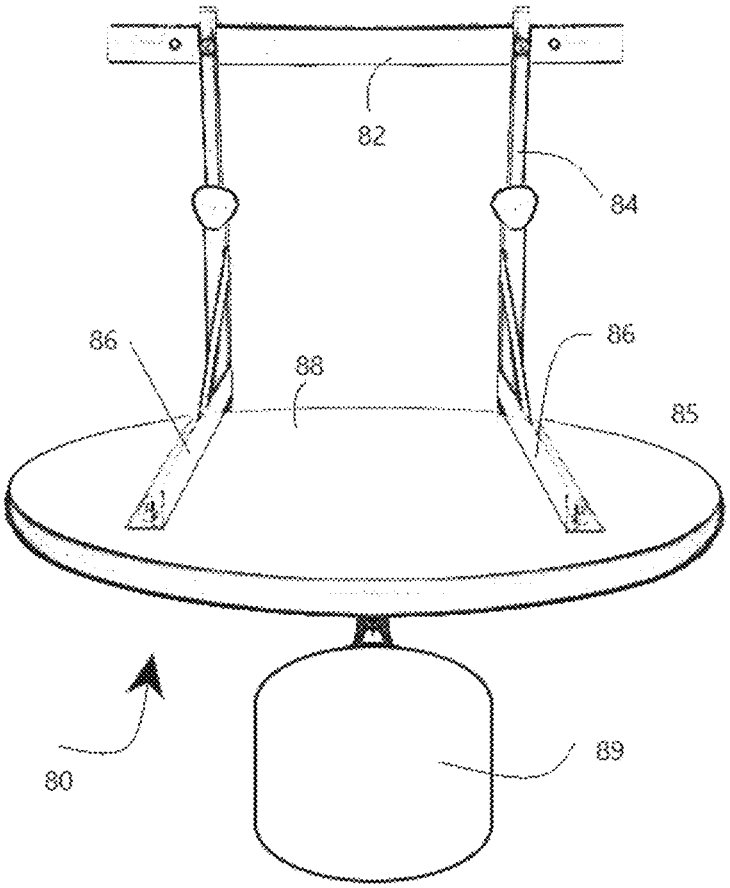
FIG. 8 is a perspective view of a speed bag and platform.
Figure 9:
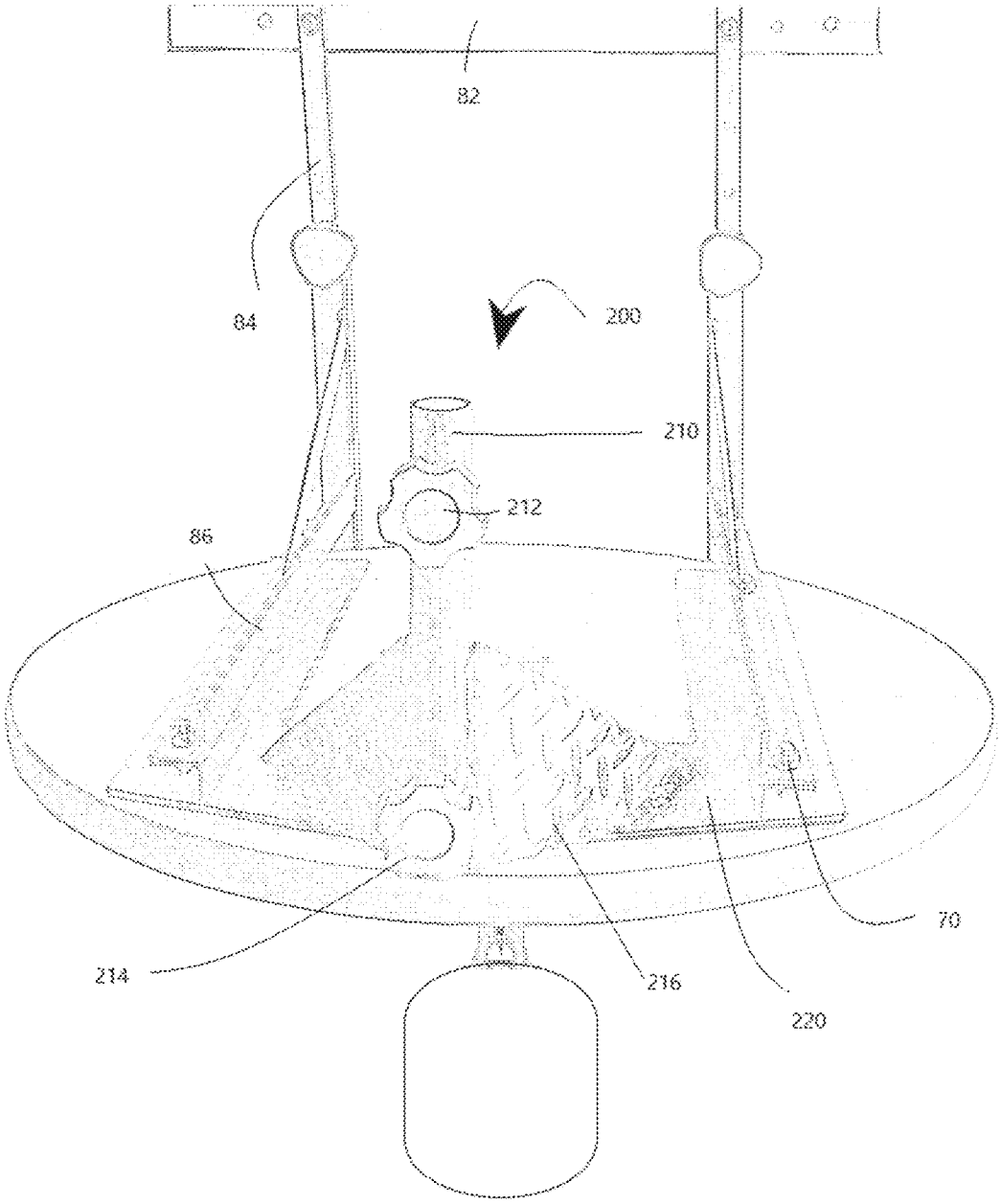
FIG. 9 is a perspective view of a speed bag and platform with a platform attachment device affixed thereto.
Figure 10:
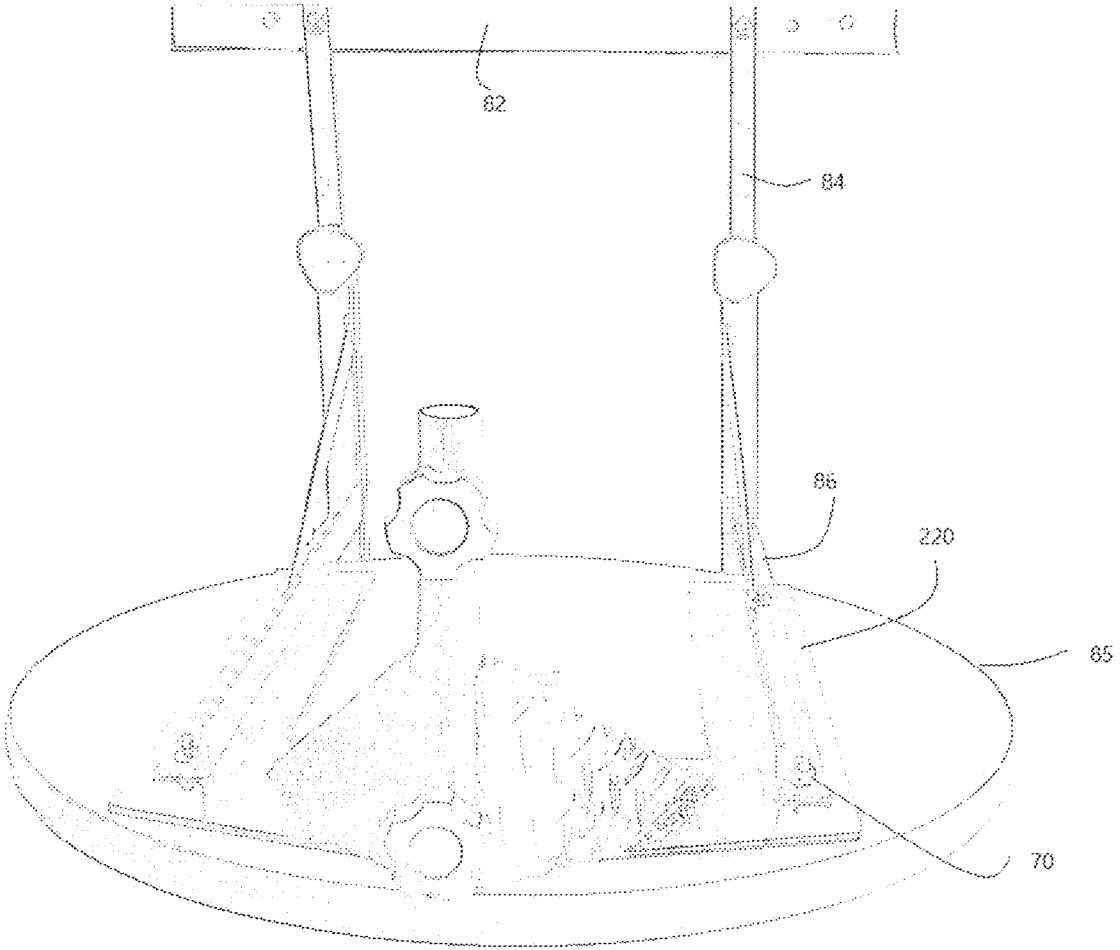
FIG. 10 is a perspective view of a speed bag platform with a platform attachment device affixed thereto.
Figure 11:
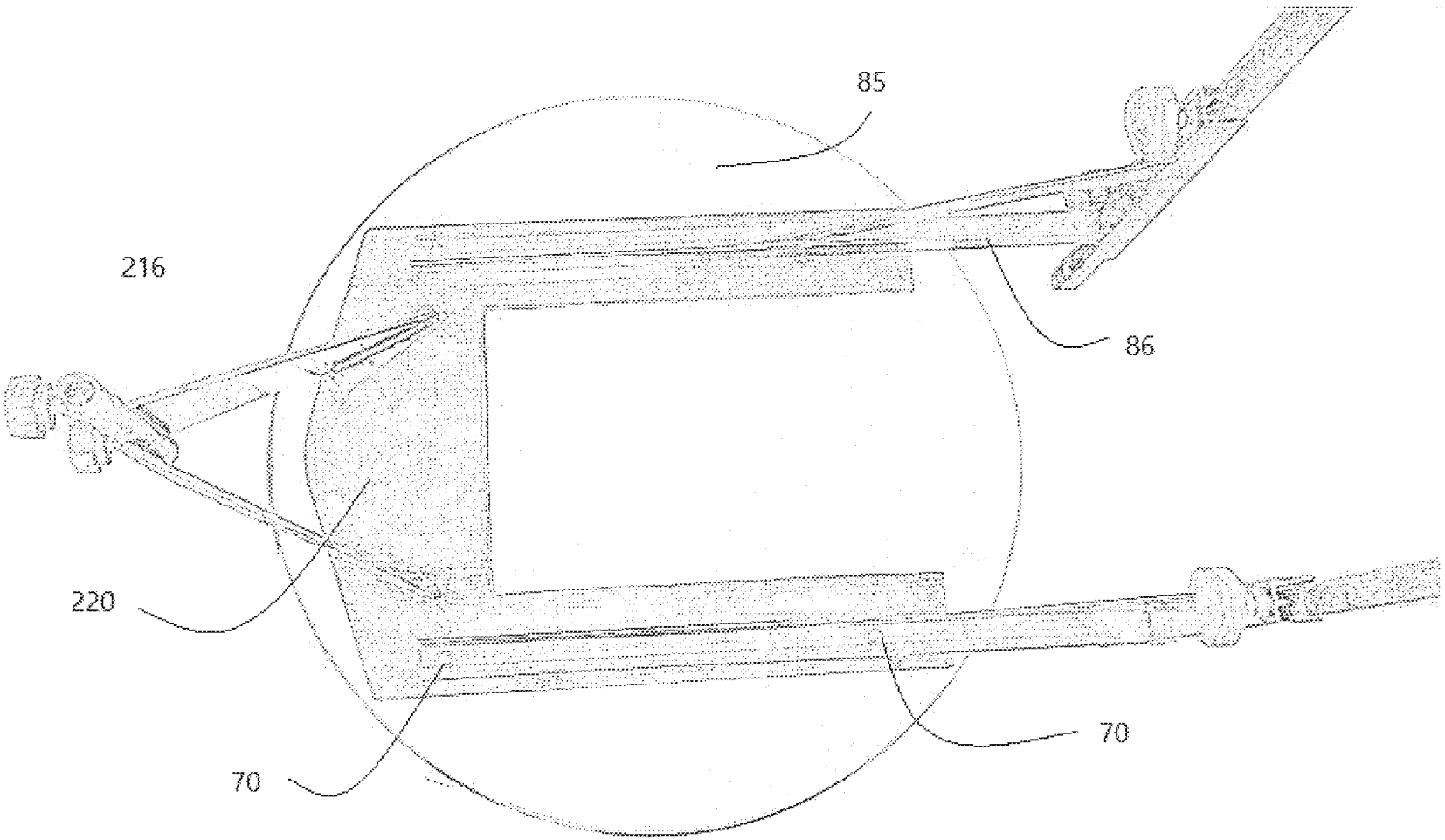
FIG. 11 is a top view of a speed bag platform with a platform attachment device affixed thereto.
Figure 12:
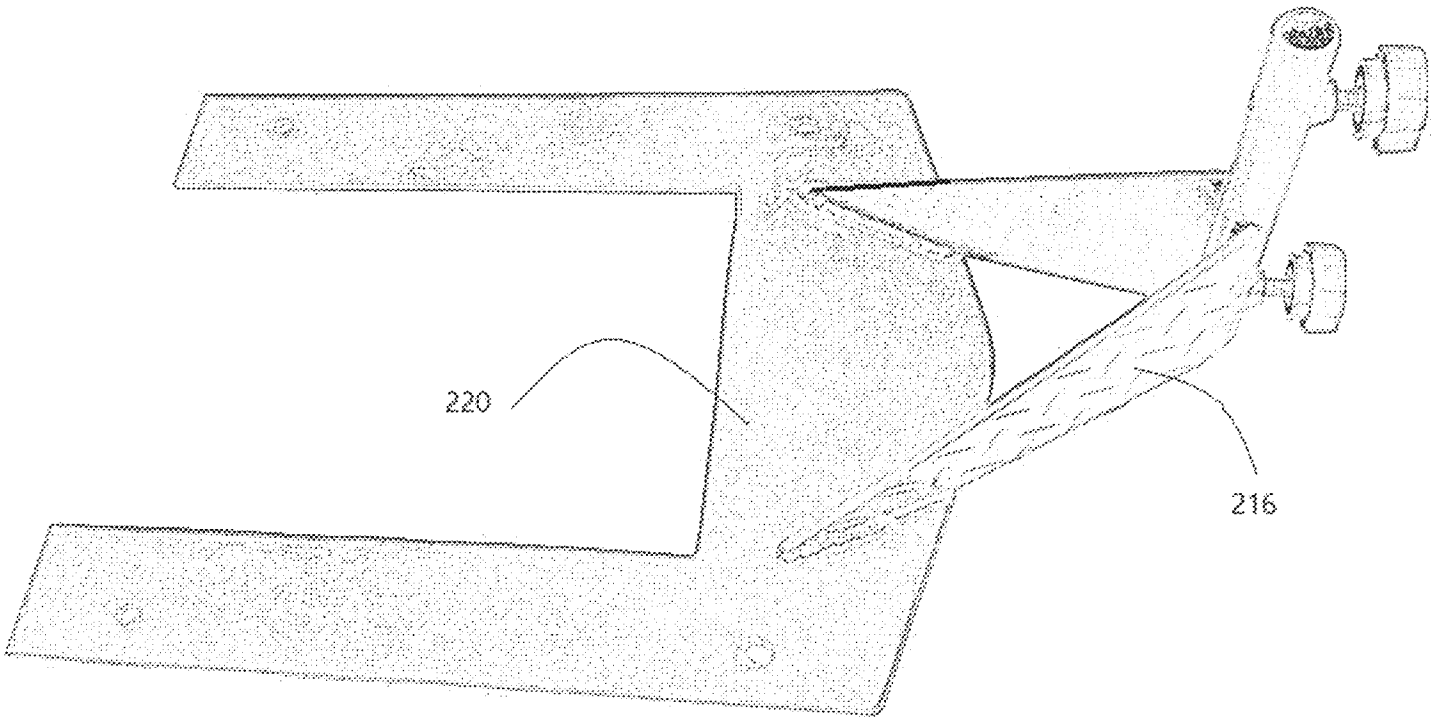
FIG. 12 is a perspective view of a platform attachment device.
Figure 13:
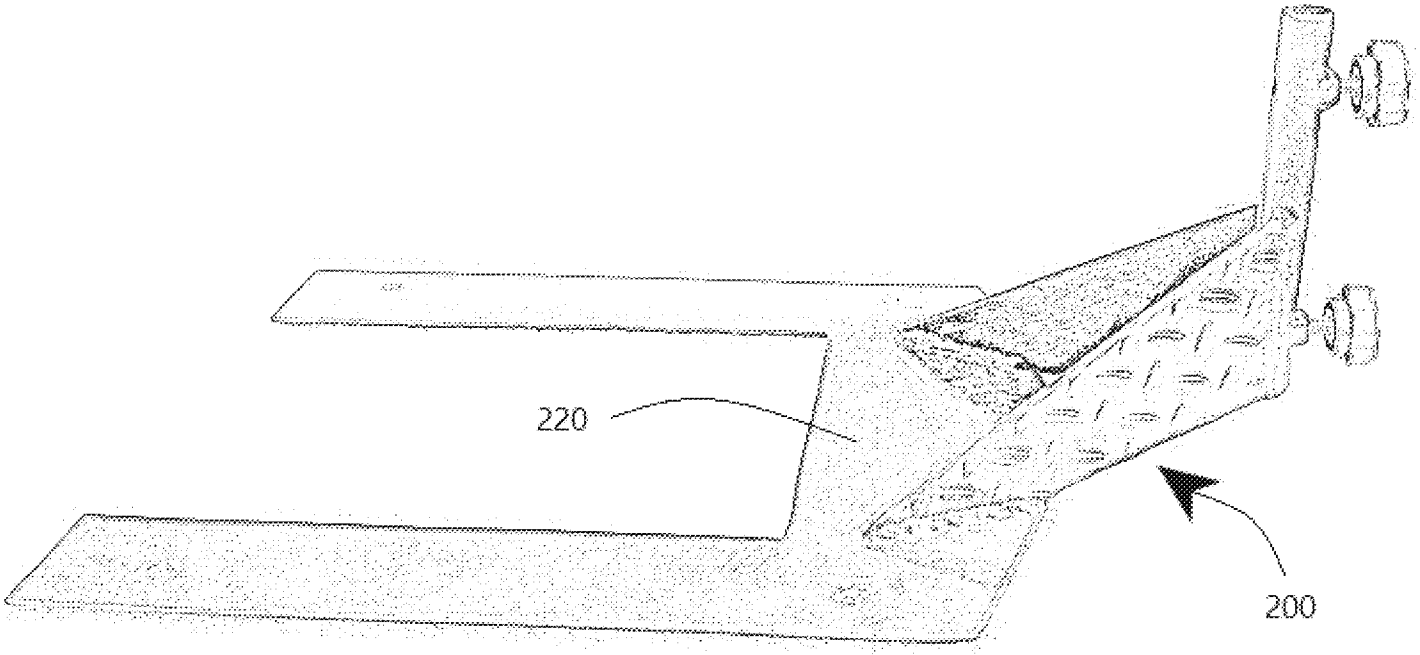
FIG. 13 is a perspective view of a platform attachment device.
Figure 14:
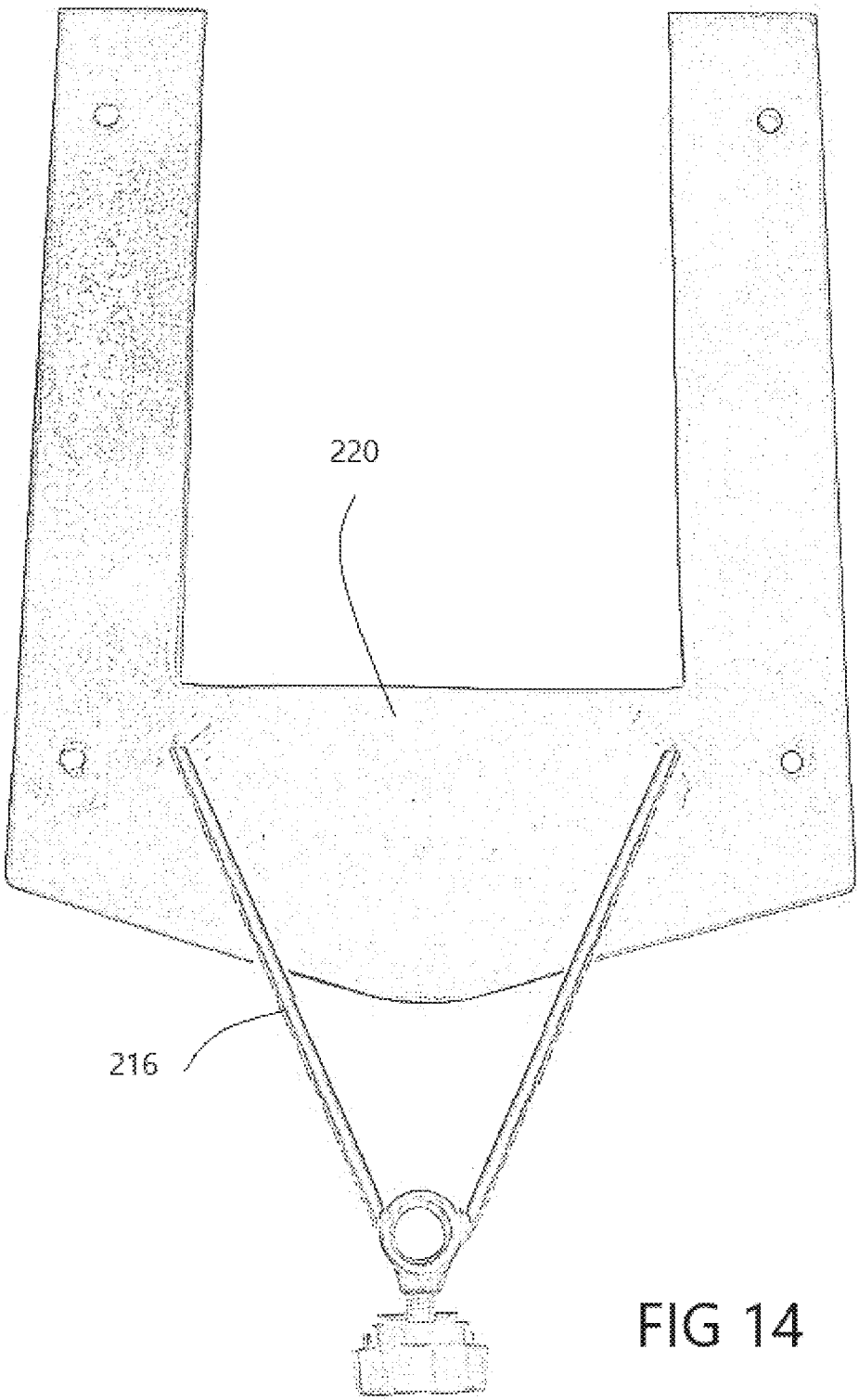
FIG. 14 is a top view of a platform attachment device.
Figure 15:
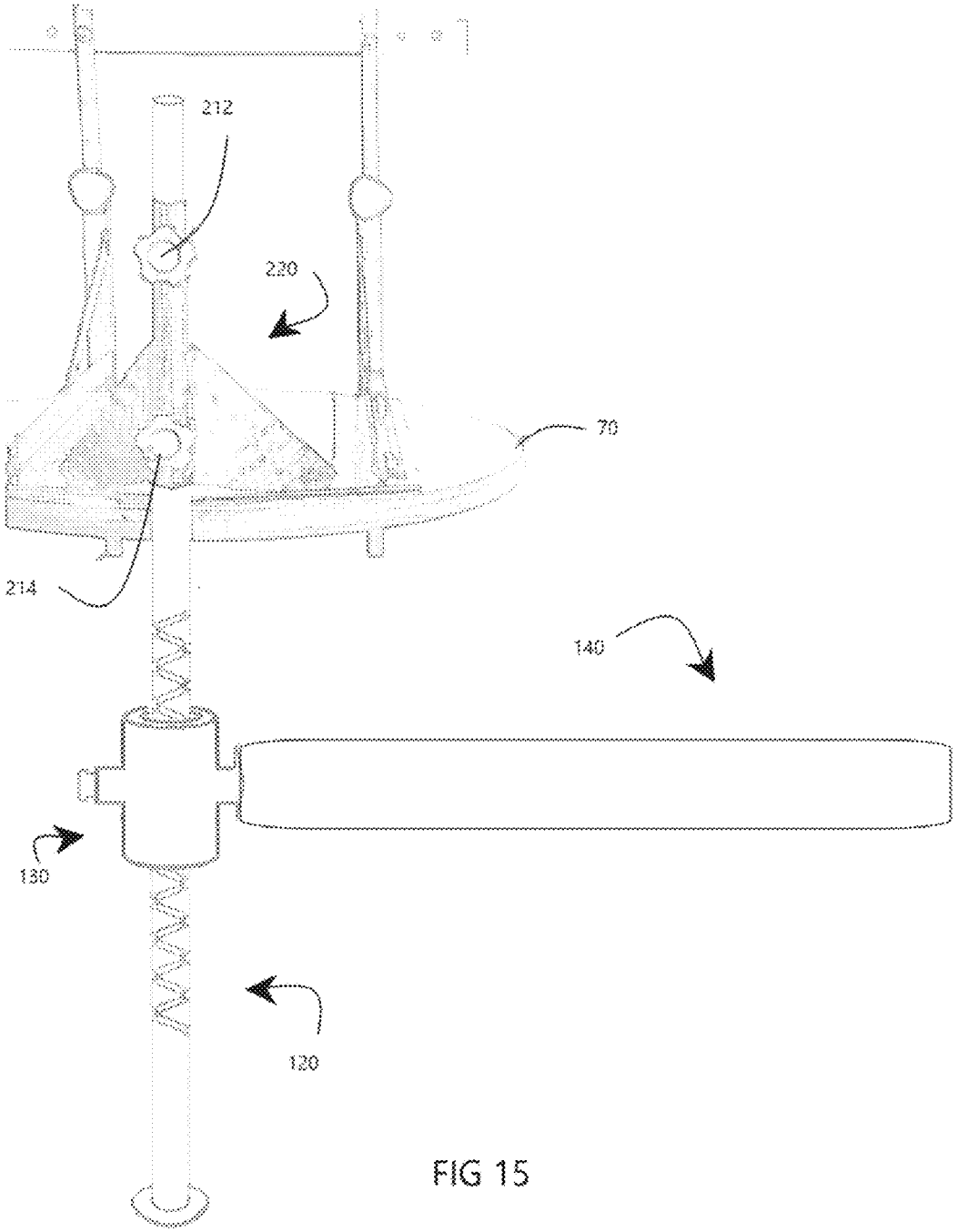
FIG. 15 is a perspective view of a speed bag platform with a platform attachment device and a reflexive training device affixed thereto.

Turning now to FIG. 8, there is shown a typical speed bag setup 80 as known in the prior art. The speed bag setup 80 includes a wall plate 82 affixed to a stable structure such as a wall and at least one wall bracket 84 extending from the wall plate to the platform bracket 86. The platform bracket 86 connects to the platform 88, which supports the speed bag 89. In gyms and home training setups, it is desirable to have training equipment that can share space or perform multiple functions. Therefore, attaching to stable structures such as platforms, I-beams or ring posts is beneficial.

Turning now to FIGS. 9-15 there is shown an embodiment of a reflexive training device attached to a speed bag setup 80. A platform attachment device 200 is connected to the speed bag setup 80 in a manner to allow for the speed bag setup to be used either for speed bag training or for training with a reflexive training device of the present invention. The platform attachment device 200 affixes to the platform 88 by use of a plurality of platform attachment devices 70. In one embodiment, the platform attachment devices are nuts and bolts. It is understood that while a particular pattern and shape for the attachment plate 220 is shown, the attachment plate can be customized to fit any platform. Referring again to FIGS. 9-15 the attachment plate 220 is affixed to the platform 88. Reinforcement 216 connects the attachment plate 220 to the vertical member housing 210. Reinforcement 216 can be any suitably ridged material to provide rigidity, such as, but not limited to steel plate. The vertical member housing 210 allows for attachment of the vertical member 120. In one embodiment, the vertical member housing 210 is a made from steel, aluminum, polymer or plastic. In one embodiment, the vertical member hosing 210 is about 10 inches in length and has an inner diameter of about 1.3 inches to receive a vertical member. The vertical member retention device 212 and 214 is in communication with the vertical member housing 210 and allows for the attachment and securing of the vertical member 120. The platform attachment device 200 is constructed of a sufficiently ridged and durable material. In one embodiment, the platform attached device 200 is steel, aluminum, wood, plastic or polymer. It is understood that while the platform attachment device 200 and platform 88 are depicted as distinct elements, embodiments where these components are integrated into a single unit are contemplated.

Figure 16:
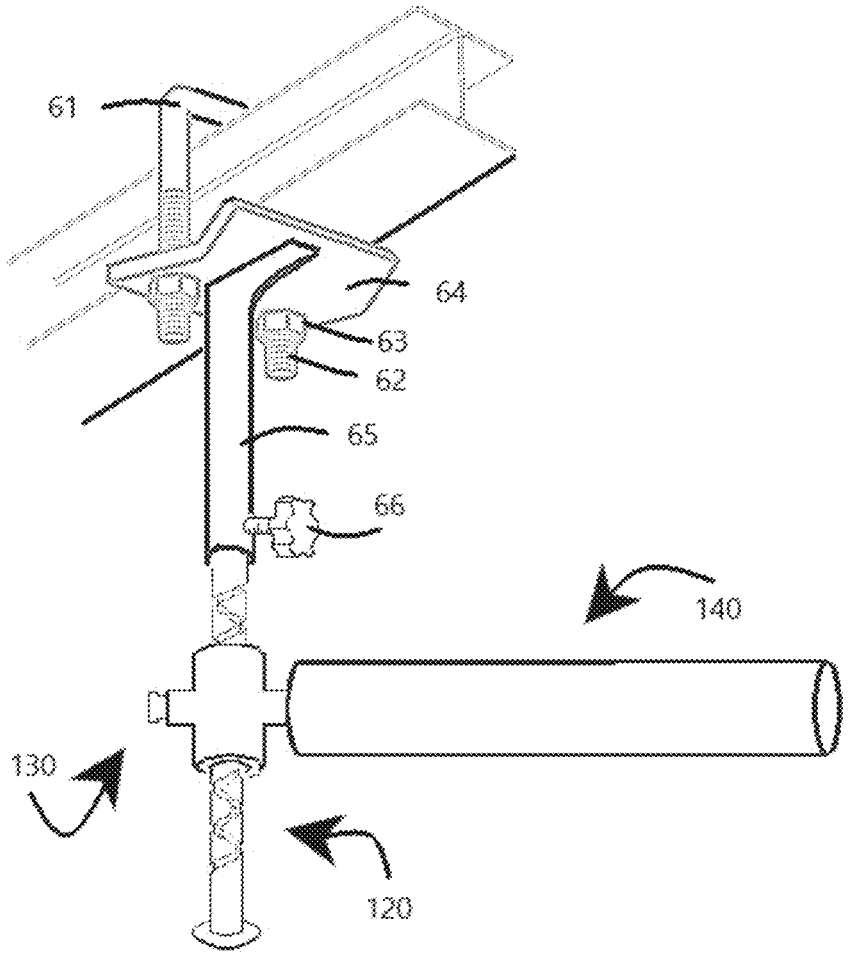
FIG. 16 is a perspective view of an I-beam with a reflexive training device affixed thereto.

Referring now to FIG. 16, there is shown a reflexive training device attached to an overhead I-beam. I-beams are often located in training facilities to support heavy bags on other training tools. By creating an attachment for an existing location, a reflexive training device can be included in the training facility with less remodeling. An I-beam hanger 61 partially surrounds an I-beam 60. The I-beam hanger 61 is placed through holes of the hanger reinforcement 64 and nuts 63 are secured to the threaded portion 62 to secure the hanger reinforcement 64 against the I-beam 60 to create a ridged support. A hanger vertical member housing 65 is connected to the hanger reinforcement 64. The vertical member 120 attaches to the hanger vertical member housing 65 and is secured by the hanger locking mechanism 66.

Figure 17:
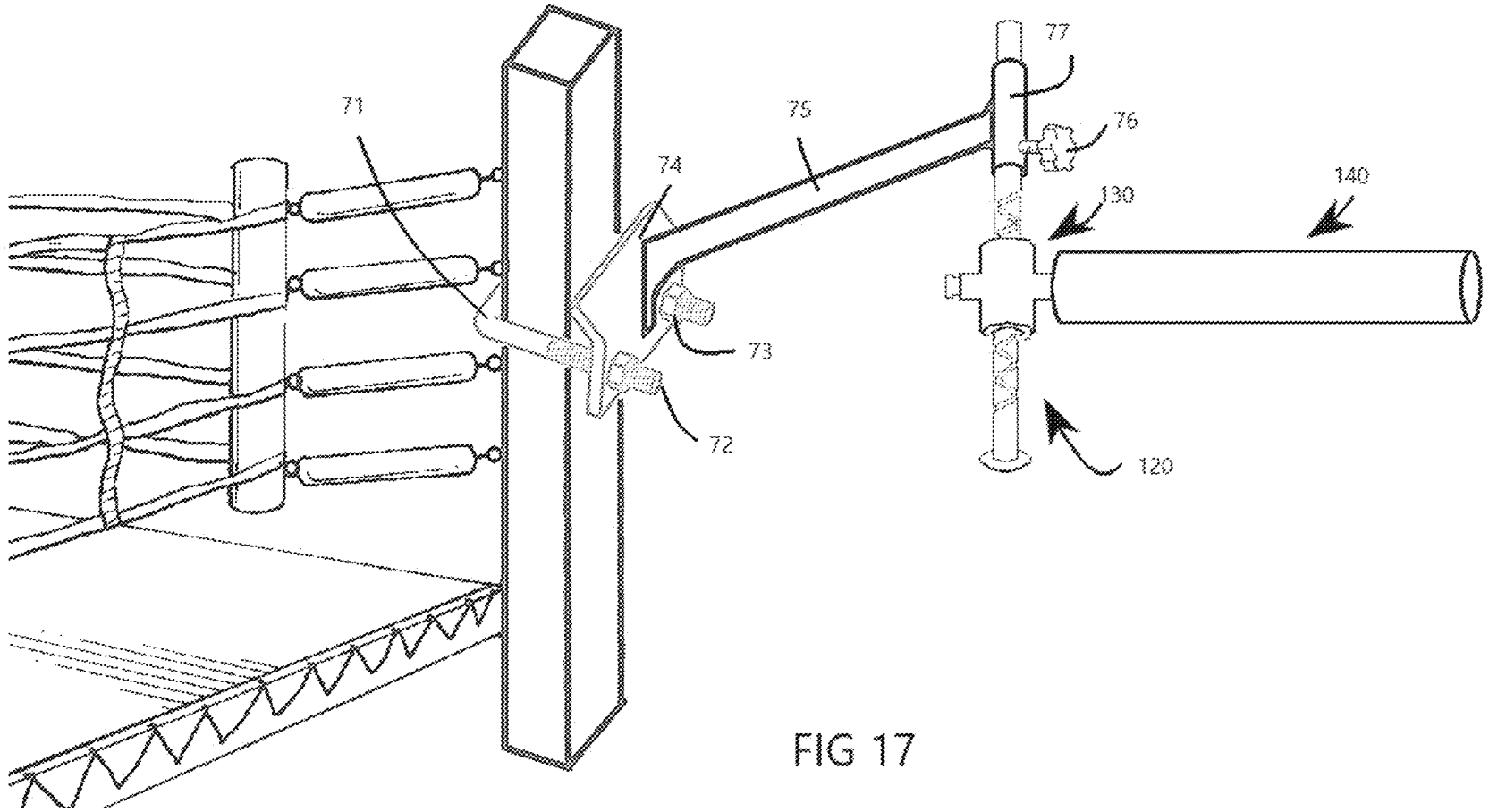
FIG. 17 is a perspective view of a ring post with a reflexive training device affixed thereto.

Referring now to FIG. 17, there is shown a reflexive training device attached to a ring post. The post hanger 71 partially surrounds the ring post. The post hanger 71 is placed through holes of the post reinforcement 74 and nuts 73 are secured to the threaded portion 72 to secure the post reinforcement 74 against the ring post to create a ridged support. The post extension 75 extends between the post reinforcement 74 and the post vertical member housing 76 to provide sufficient space for the rotating member 140 to rotate freely without contacting the boxing ring or ring post. The vertical member 120 attaches to the post hanger vertical member housing 76 and is secured by the post locking mechanism 77.

Figure 18:
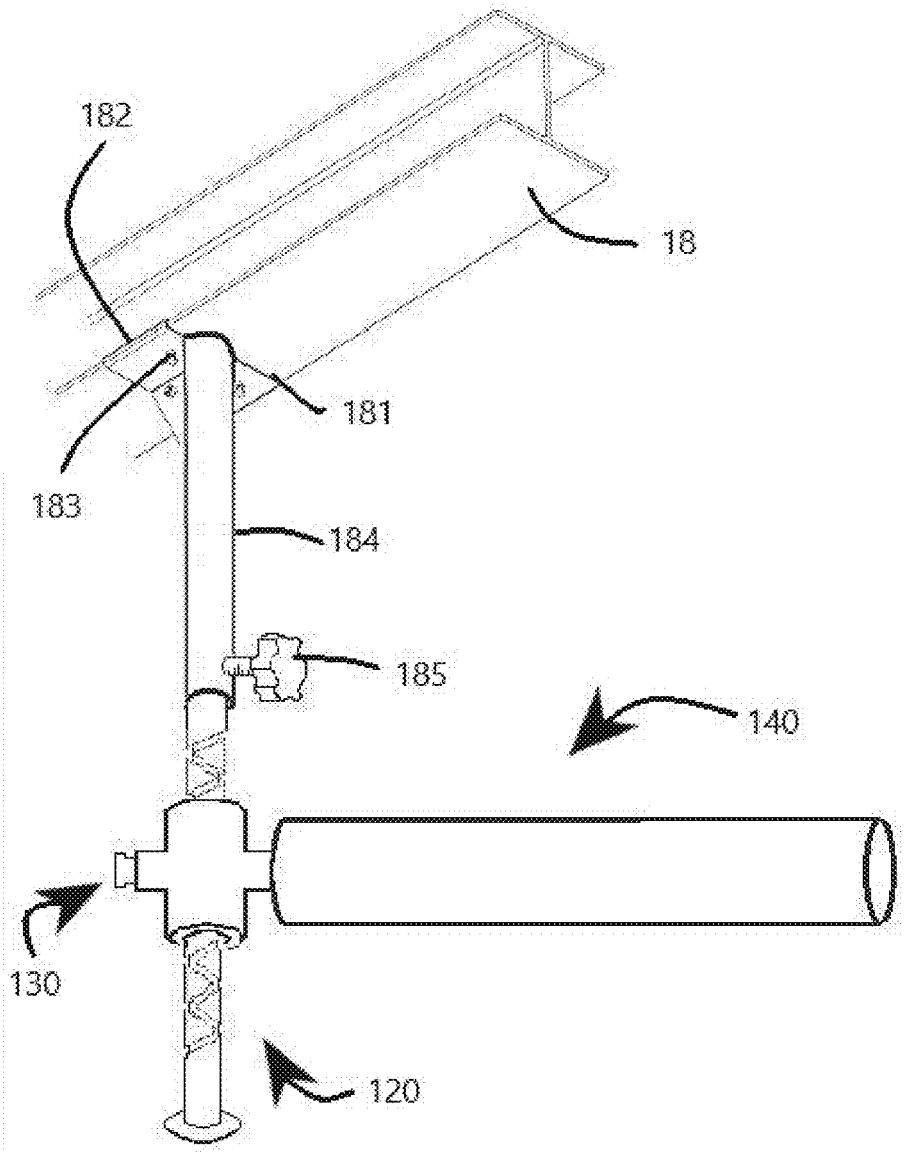
FIG. 18 is a perspective view of an I-beam with a reflexive training device affixed thereto.

Referring now to FIG. 18, there is shown an embodiment of a reflexive training device attached to an overhead I-beam. A beam retention 181 partially surrounds a portion of an I-beam 18. A beam coupling 182 grasps a lip of the I-beam 18. Optional beam attachments 183, such as friction mounts or bolts are utilized to provide additional support. A beam vertical member housing 184 is connected to the beam retention 181. The vertical member 120 attaches to the beam hanger vertical member housing 184 and is secured by the hanger locking mechanism 185.

Figure 19:
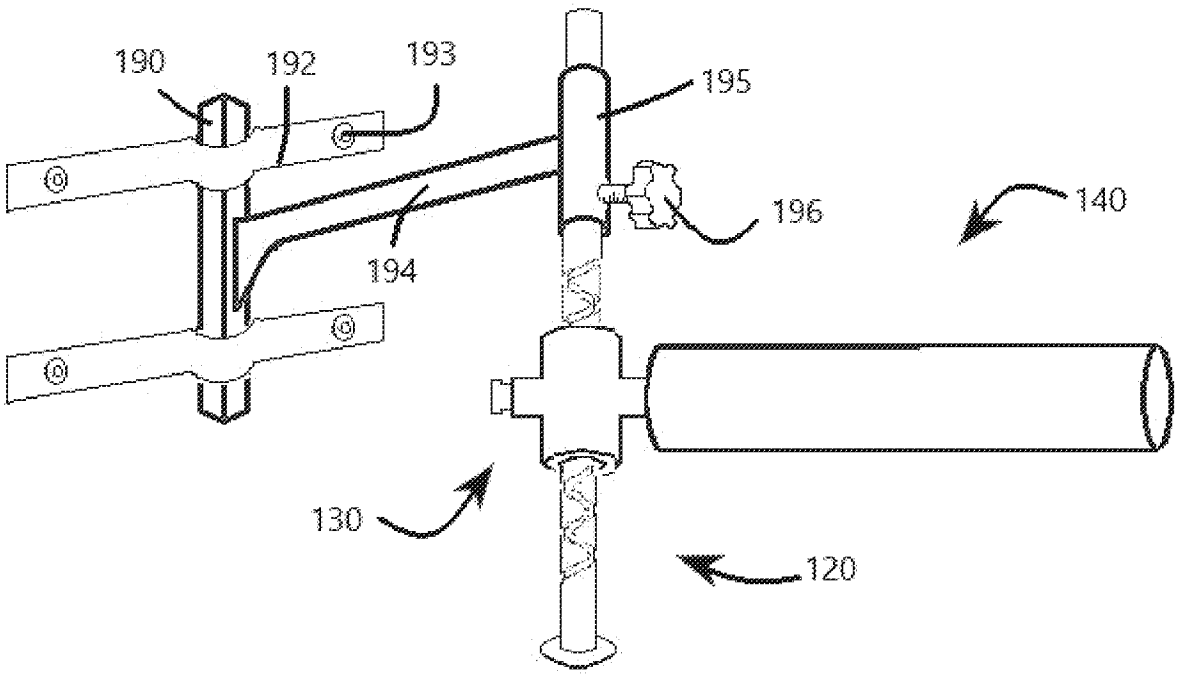
FIG. 19 is a perspective view of a wall mount with a reflexive training device affixed thereto.

Referring now to FIG. 19, there is shown an embodiment of a reflexive training device attached to a wall. A wall mount 190 is placed against a wall and at least one wall mount band 192 attaches to the wall mount. The wall mount band(s) 192 are attached to the wall via wall mount attachment device 193. The wall mount attachment device will vary depending on the wall material and may include screws, bolts, concrete anchors or the like. The extension 194 extends from the wall mount and provides sufficient clearance for the rotating member 140 to rotate without contacting the wall. A wall mount vertical housing 195 is connected to the extension 194 and allows for the vertical member 120 to attach to the wall mount vertical housing 185 and is secured by the locking mechanism 196.

Figure 20:
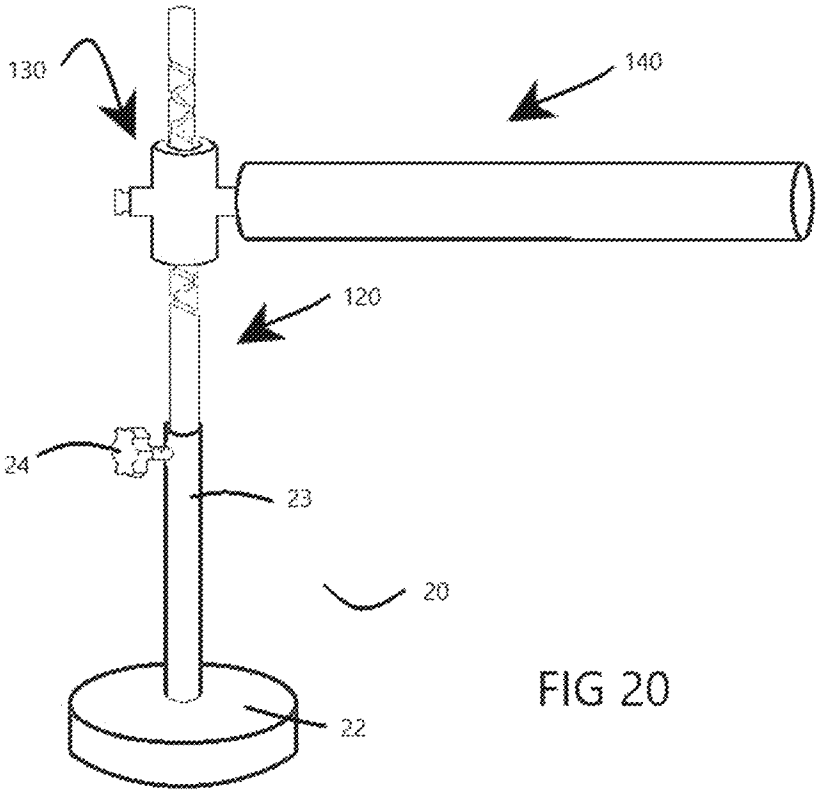
FIG. 20 is a perspective view of a free-standing reflexive training device.

Referring now to FIG. 20, there is shown an embodiment of a reflexive training device in a free-standing base. The stand 20 contains a weighted base 22 having a vertical member housing 23 extending from the base 22. The weighted base 22 can be a container weighted with fluid, sand or the like to provide a stable structure to the reflexive training device when in use. Such containers include, but are not limited to blow molded plastic, polymers and the like. The vertical member 120 attaches to the vertical member housing 23 and is secured by the locking mechanism 24. In an embodiment, the average height of the threads 124 is between 3 and 4 feet above the lower portion of the base 22. In an embodiment, the weighted base 22 is a steel plate capable of being bolted to the floor or formed such that one or more sand bags are weighted plates can be placed on top to provide stability. In another embodiment, the weighted base 22 is made a material sufficiently weighted to provide stability without the addition of additional weighted materials.

Figure 21:
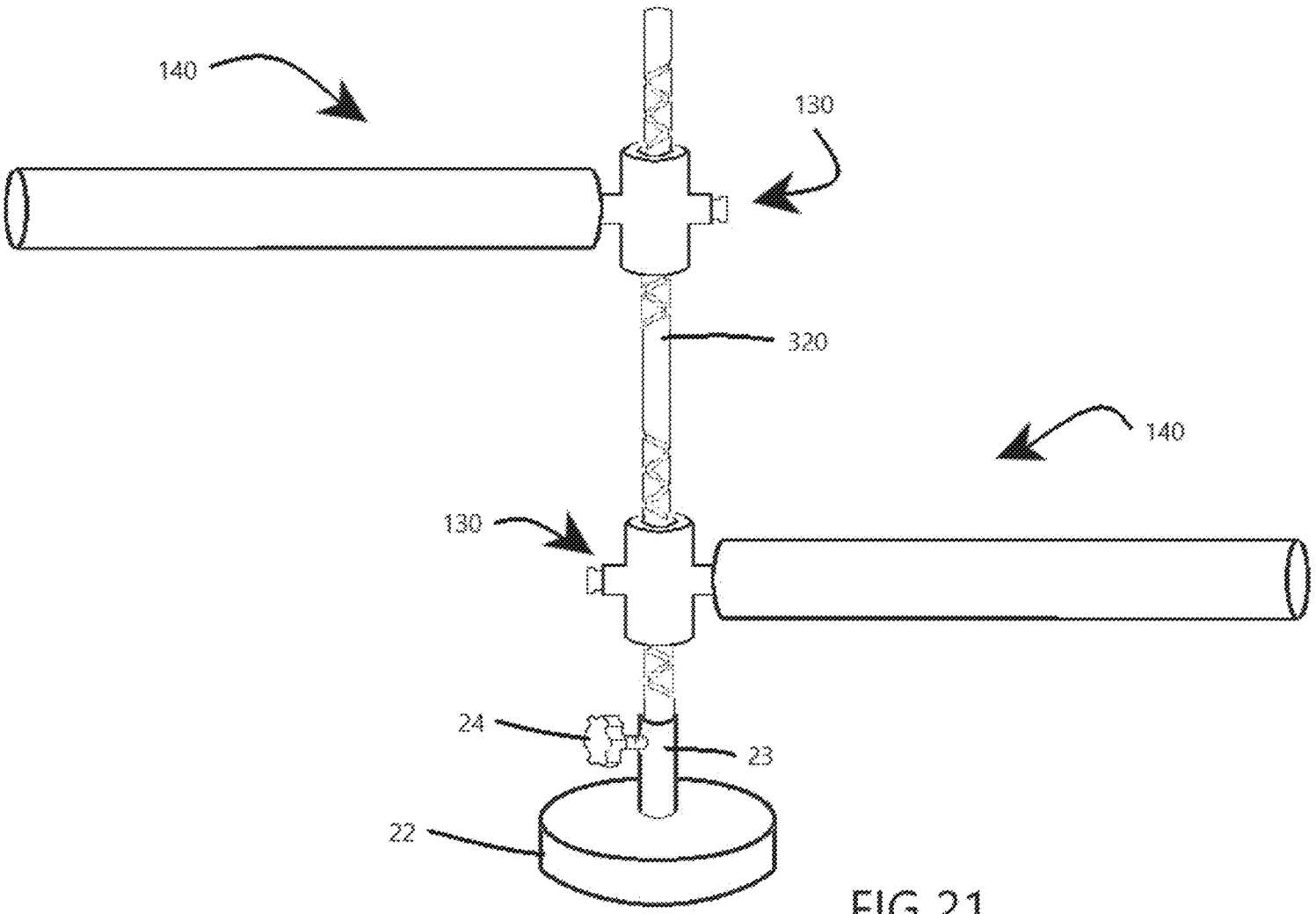
FIG. 21 is a perspective view of a free-standing reflexive training device.

Referring now to FIG. 21, there is shown an embodiment of a reflexive training device having a plurality of threaded sections and a plurality of rotating members 140 separated by a non-threaded portion of multiple portion double helical rod 320. While FIG. 21 depicts the multiple portion double helical rode 320 in a free-standing base, other attachments are contemplated.

Figure 22:
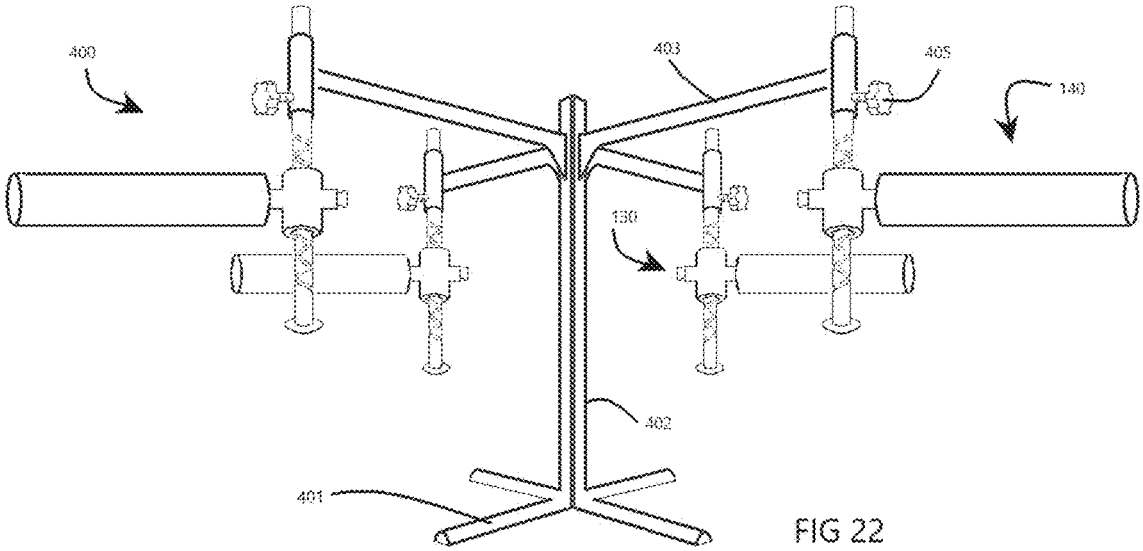
FIG. 22 is a perspective view of a multi-station reflexive training device.

Referring now to FIG. 22, there is shown an embodiment of a multi station reflexive training device. The multi station reflexive training device is useful for class settings or training facilities where multiple users would train simultaneously. The multi-station free standing device 400 has a base 401 to provide sufficient stability when in use. While a number of legs are shown, it is contemplated that other base options are contemplated such as non-movable mounts, weighted bases or legs. A riser 402 extends from the base and a plurality of extensions 403 extend from the riser 402. The vertical members 120 attach to vertical member housing 404 and is secured by the locking mechanism 405.

Figure 23:
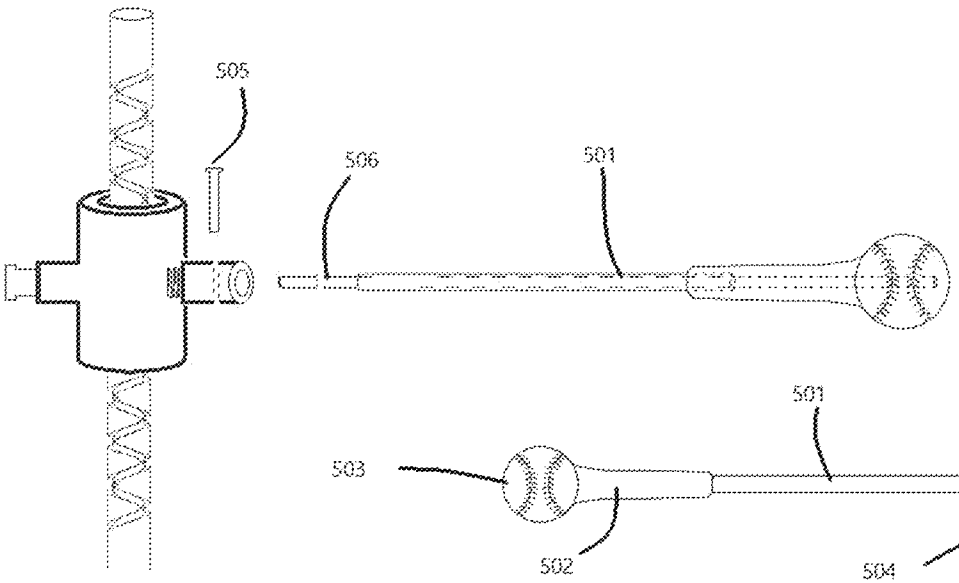
FIG. 23 is a perspective view of a baseball training device.
Figure 24:
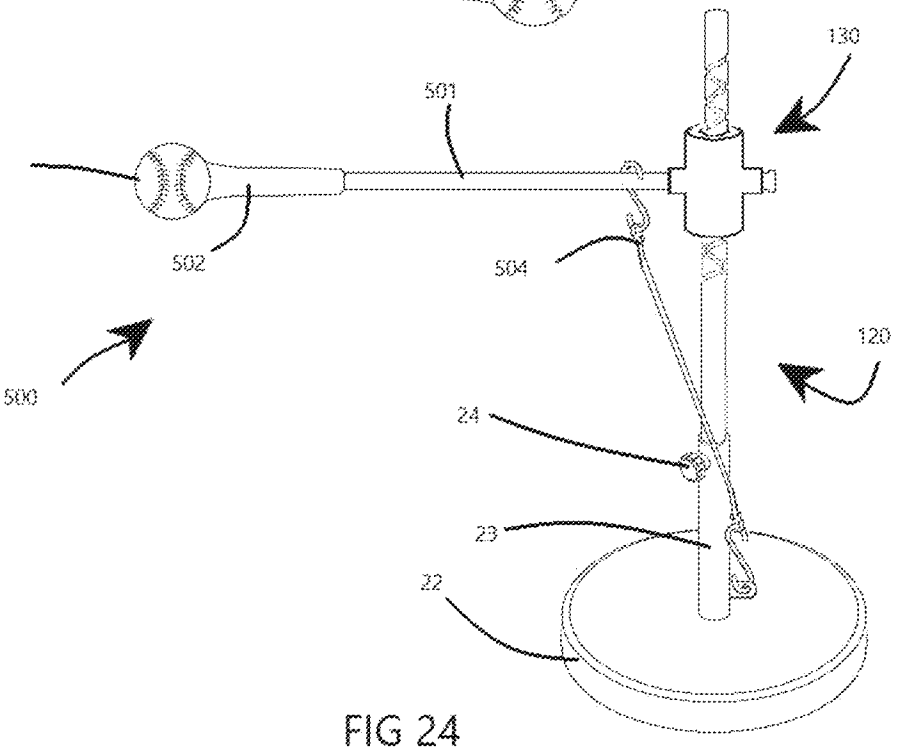
FIG. 24 is a perspective view of a reflexive training device having an energy storage/release mechanism.

Referring to FIGS. 23-24, there is shown an embodiment of a reflexive training device having a recoil option. In addition, the reflexive training device shown in FIGS. 23-24 has a baseball attachment. While the stand, rotating bracket and vertical member are similar as described in other embodiments herein, the rotating member contains distinct features suitable for striking the baseball training device 500 with a baseball bat. The baseball training device 500 has a rod 501 extending from the rotating bracket. In an exemplary embodiment, the rod 51 is a steel rod 30 inches in length having a ½ inch diameter. It is understood that different sizes and materials are suitable, including, but not limited to graphite, plastic or polymer. The rod 501 has protection 502 that protects the rod from damage from errant strikes. The protection 502 may be a nylon sleeve about 10 inches in length having a 2 inch diameter. The protection 502 attaches to the rod 501 and also to the contact area 503. A contact area 503 is positioned at the end of the rod 501. A retention device 505 such a pin or bolt, it used to connect an attachment area 506 in the rod 501. In use, when a user strikes the contact area 503 the rod 501 spins around the vertical member 120. The contact area 503 may represent a baseball, softball, tennis ball or the like. The spinning of the rod 501 causes the energy storage/release mechanism 504 to store energy and then release that stored energy to cause the rod 501 to rotate in the opposite direction. In an embodiment, the energy storage/release mechanism 504 is one or more rubber bungies.

Figure 25:
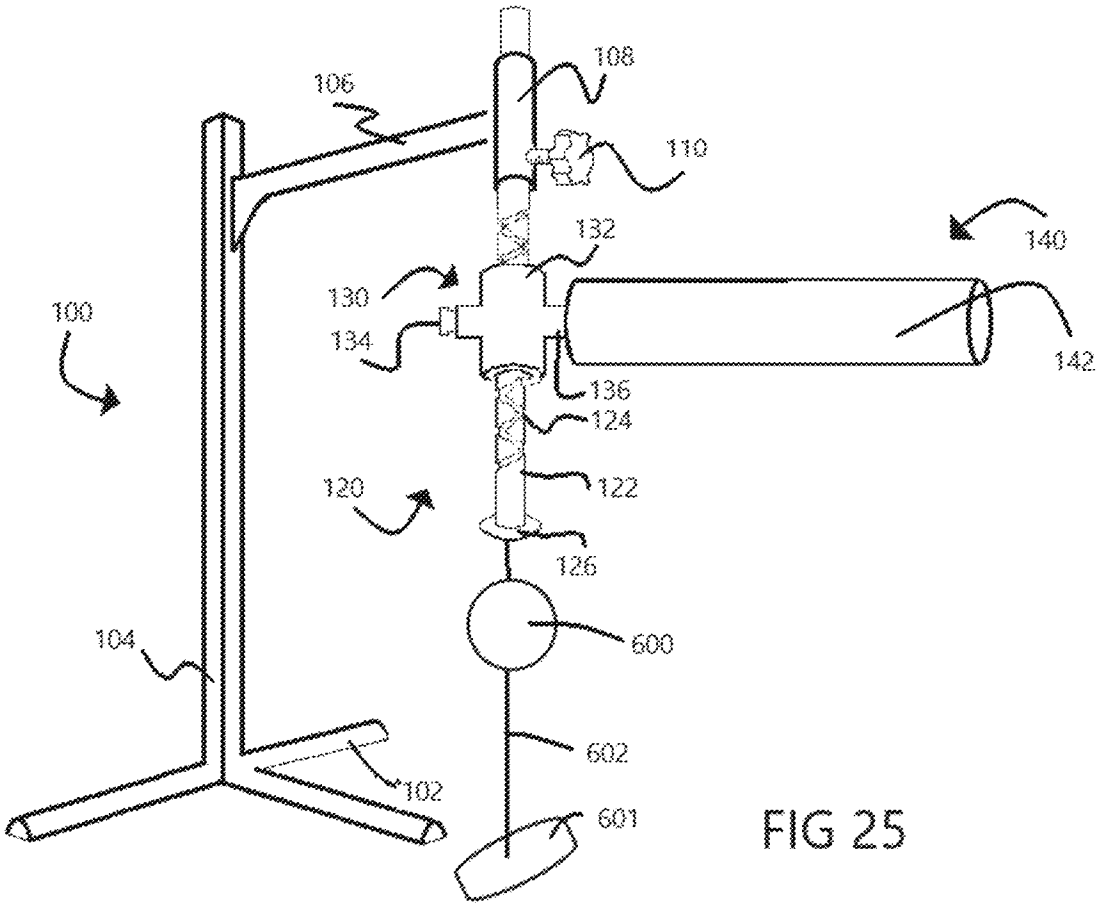
FIG. 25 is a perspective view of a reflexive training device having a secondary reflexive attachment.

Referring to FIG. 25, there is shown an embodiment of a reflexive training device having a secondary reflex mechanism option. The secondary reflex mechanism 600 is supported by an elastic retention 602 which is attached to the vertical member 120 on a first end and a lower attachment 601 on a second end. The secondary reflex mechanism 600 is a device to allow the user to strike an additional area such as a ball, disc or bag. In one embodiment, the secondary reflex mechanism is a substantially spherical shaped object. The elastic member 602 may either attach to either end of the secondary reflex mechanism 600, or pass through an opening in the reflex mechanism. The elastic member should have enough flex and rebound to absorb the energy from a strike while imparting movement on the reflex mechanism 600.

The invention has been described with reference to a preferred embodiment. However, it will be appreciated that variations and modifications can be effected by a person of ordinary skill in the art without departing from the scope of the invention. For example, an embodiment utilizing a tennis ball instead of a baseball is contemplated. In addition, while locking mechanisms are shown in various embodiments, it is also contemplated that the vertical member attaches to the vertical member housing by being connected by threads or welds.

The invention should therefore not be limited by the above described embodiment, method, and examples, but by all embodiments and methods within the scope and spirit of the invention.

PARTS LIST

17—Boxing ring post
18—I-beam
20—Stand
22—Weighted base
23—Vertical member housing
24—Locking mechanism
60—I-beam
61—I-beam hanger
62—Threaded portion
63—Nut
64—Hanger reinforcement
65—Hanger vertical member housing
66—Hanger locking mechanism
70—Platform attachment device
71—Post hanger
72—Threaded portion
73—Nut
74—Post reinforcement
75—Post extension
76—Post vertical member housing
77—Post locking mechanism
80—Speed bag setup
82—Wall plate
84—Wall bracket
86—Platform bracket
88—Platform
89—Speed bag
100—Stand
102—Legs
104—Vertical support
106—Horizontal support
108—Vertical member housing
110—Locking mechanism
120—Vertical member
122—Double helical rod
124—Threads
126—Limit stop
130—Rotating bracket
131—Vertical member contact
132—Housing
134—Engagement device
135—Retention device
136—Rotating member housing
137—Engagement member
140—Rotating member
142—Wrap
144—Wrap attachment
146—Cushioning
148—Core
181—Beam retention
182—Beam coupling
183—Beam attachment
184—Beam vertical member housing
185—Locking mechanism
190—Wall mount
192—Wall mount band
193—Wall mount attachment device
194—Extension
195—Wall mount vertical housing
196—Locking mechanism
200—Platform attachment device
210—Vertical member housing
212—Vertical member retention device
214—Vertical member retention device
216—Reinforcement
220—Attachment plate
320—Multiple portion double helical rod
400—Multi-station free standing device
401—Base
402—Riser
403—Extension
404—Vertical member housing
405—Locking mechanism
500—Baseball training device
501—Rod
502—Protection
503—Contact area
504—Energy storage/release mechanism
505—Retention device
506—Attachment area
600—Reflex mechanism
601—Lower attachment
602—Elastic retention

I claim:

1. A reflexive training device comprising:

a. a vertical member having double helical threads extending from a first portion to a second portion in a first plane along said vertical member, b. a rotating bracket in communication with said double helical threads, and c. a rotating member in communication with said rotating bracket; whereas said rotating member, when in motion, rotates along a second plane orthogonal to said first plane; and said motion imparts movement of said rotating member in said first plane.

2. The reflexive training device of claim 1 wherein said rotating bracket further comprises a spring-loaded engagement member, which when engaged, is in communication with said threads.

3. The reflexive training device of claim 1 wherein each full rotation of the rotating member in said second plane causes the rotating member to travel at least 0.25 inches in said first plane.

4. The reflexive training device of claim 1 wherein said rotating member is a substantially cylindrical shape.

5. The reflexive training device of claim 4 further wherein said rotating member is at least 10 inches in length.

6. The reflexive training device of claim 1 wherein said double helical threads extend for at least 7 inches along said first plane on said vertical member.

7. The reflexive training device of claim 1 further comprising at least one metric sensor.

8. A reflexive training device comprising:

a. a mount comprising:
   i. an attachment portion to affix said mount to a stable structure;
   ii. a vertical member housing sized to house a vertical member; and
   iii. at least one locking mechanism, which when engaged, retains said vertical member within said vertical member housing;

b. said vertical member having double helical threads extending from a first portion to a second portion in a first plane along said vertical member, c. a rotating bracket in communication with said double helical threads, and d. a rotating member in communication with said rotating bracket; whereas said rotating member, when in motion, rotates along a second plane orthogonal to said first plane; and said motion imparts movement of said rotating member in said first plane.

9. The reflexive training device of claim 8 wherein said mount is a free-standing mount.

10. The reflexive training device of claim 8 wherein vertical member further comprises at least one lock retention features to receive said at least one locking mechanism.

11. A method for training comprising the steps of:

a. striking a rotating member causing said rotating member to rotate in a second plane;
   said rotating member being in communication with a rotating bracket, said rotating bracket having an engagement mechanism;
   said engagement mechanism being engaged with double helical threads extending in a first plane along a vertical member;
   whereas the rotation of said rotating member in said second plane causes said engagement member to slide along said double helical threads thereby causing the rotating bracket and rotating member to move is said first plane b. performing an action selected from the group consisting of:
   i. dodging said rotating member;
   ii. blocking said rotating member; or
   iii. striking said rotating member causing said rotating member to rotate in an opposite direction in said second plane and thereby casing said rotating member to move in the opposite direction in said first plane.

* * * * *